US006581243B2

(12) United States Patent
Parizel

(10) Patent No.: US 6,581,243 B2
(45) Date of Patent: Jun. 24, 2003

(54) HINGE WITH BUILT-IN DOOR STOP

(75) Inventor: Francis Parizel, Bievres (FR)

(73) Assignee: Oxford Automotive Mecanismes et Decoupage Fin, Les Ulis (FR)

( * ) Notice: Subject to any disclaimer, the term of this patent is extended or adjusted under 35 U.S.C. 154(b) by 0 days.

(21) Appl. No.: 09/892,478

(22) Filed: Jun. 28, 2001

(65) Prior Publication Data

US 2002/0023313 A1 Feb. 28, 2002

(30) Foreign Application Priority Data

Jun. 29, 2000 (FR) ..... 00 08418

(51) Int. Cl.[7] ..... E05D 11/02; E05D 11/06; E05D 11/08; E05D 11/10

(52) U.S. Cl. ..... 16/334; 16/344; 16/375

(58) Field of Search ..... 16/332, 334, 335, 16/321, 374, 375, 344, 327, 261–264, 380, 381

(56) References Cited

U.S. PATENT DOCUMENTS

| | | | | | |
|---|---|---|---|---|---|
| 2,992,451 | A | * | 7/1961 | Schonitzer et al. | 16/327 |
| 3,643,289 | A | | 2/1972 | Lohr | 16/327 |
| 4,628,568 | A | * | 12/1986 | Lee et al. | 16/337 |
| 4,672,715 | A | * | 6/1987 | Beckwith | 16/334 |
| 5,926,917 | A | * | 7/1999 | Gantz | 16/334 |
| 6,073,308 | A | | 6/2000 | Linnenbrink et al. | 16/334 |

FOREIGN PATENT DOCUMENTS

| | | | |
|---|---|---|---|
| DE | 196 06 186 A1 | * | 4/1997 |
| DE | 296 04 089 U1 | * | 8/1997 |
| DE | 196 42 597 A1 | * | 7/1998 |
| DE | 298 06 087 U1 | * | 9/1999 |
| DE | 2 804 992 | * | 8/2001 |
| EP | 0 769 600 A2 | * | 4/1997 |
| EP | 0 794 308 A1 | * | 9/1997 |

* cited by examiner

*Primary Examiner*—Robert E. Pezzuto
*Assistant Examiner*—Tara L. Mayo
(74) *Attorney, Agent, or Firm*—Young & Thompson

(57) ABSTRACT

A vehicle door hinge assembly with a built-in doorstop mechanism, includes a fixed knuckle secured to the bodywork of the vehicle, and a moving knuckle secured to the door of the vehicle. The moving knuckle is hinged to the fixed knuckle about a pin. The hinge assembly also includes a notched cam secured to the moving knuckle, a contact surface that can be inserted in a notch of the cam during an operation of opening the door, a compression spring, a support connected to the fixed knuckle and against which one end of the compression spring bears, and a part hinged to the support about a pin passing through the support and the part hinged to the support and constituting a moving part, against which the other end of the compression spring bears.

10 Claims, 1 Drawing Sheet

HINGE WITH BUILT-IN DOOR STOP

BACKGROUND OF THE INVENTION

The invention relates to the field of the motor industry. More specifically, it relates to a hinge assembly for a motor vehicle side swing door having a built-in door stop.

In general, the motor industry uses three elements for fixing and rotating a vehicle side swing door and for holding it in a predefined angular position. These elements are an upper hinge and a lower hinge, both allowing the door to be fixed and to rotate, and a door stop system allowing the door to be held in one or more predefined angular positions. The door stop system also has the function of stopping the door when it has reached its wide-open position.

In some cases, at least one of the two hinges has a door stop device built into it. Such door hinges with built-in door stop are described, in particular, in the following documents: DE-A-29806087, DE-A-19642597, EPA-0 794 308, DE-A-29604089, DE-A-19606186, and EP-A-0 769 600. They in particular comprise a wire spring working in torsion and rolling over a series of rollers.

The hinges with built-in door stop which already exist on the market have various drawbacks. First of all, they are more bulky than conventional hinges because of the presence of the door stop system. The surrounding area of the vehicle has therefore to allow a significant volume so that this type of hinge can be fitted. Furthermore, because the door stop devices have metal parts rubbing against each other, they make a sharp or grinding noise when the door is being manipulated. Motor manufacturers would now like to eliminate this type of noise which is unpleasant to the user. In addition, friction between the metal parts wears the corrosion-proof coating that these might have before they are fitted; this then creates the possibility of these very parts corroding. Finally, with a view to lessening the operating noises of the door stop system, it is common practice for this system to be greased at the end of assembling the vehicle. However, it is periodically necessary to renew this grease during vehicle servicing operations, and motor manufacturers would like to eliminate this greasing stage.

In addition, dirt builds up within the grease during the life of the vehicle, and this may abrade the parts as they rub.

The applicant company, in their French patent application FR 00 01 856, proposed a type of door hinge assembly that to a great extent solved the above problems. In that door hinge assembly, which was of relatively small bulk, a moving knuckle fixed to the door is equipped with two notched metal cams against which a spring held by a fixed knuckle secured to the bodywork of the vehicle and working mainly in bending presses two rollers. A hinge pin articulates the moving knuckle to the fixed knuckle. If the rollers are made of a self-lubricating material such as plastic, then the greasing of the assembly can be dispensed with, although the greasing remains preferable if the rollers are made of metal.

The drawback of this device, however, is that it entails the use of a bending spring, which is a type of spring whose optimum characteristics for this use are more difficult to determine than those of conventional compression springs. It is also more expensive to manufacture. Finally, this bending spring extends over practically the entire height of the door hinge assembly and requires two regions of contact between the door stop mechanism and the fixed knuckle. The bulk of the active part of the door hinge assembly is therefore determined first and foremost by the dimensions that the bending spring needs to have.

The purpose of the invention is to propose a door hinge assembly with a built-in door stop which does not have a bending spring, and the bulk of the active part of which can be reduced still further by comparison with the existing devices.

SUMMARY OF THE INVENTION

To this end, the subject of the invention is a vehicle door hinge assembly with a built-in door stop mechanism, of the type comprising a fixed knuckle intended to be secured to the bodywork of the vehicle, a moving knuckle intended to be secured to the door of the vehicle, and means of hinging the said moving knuckle to the said fixed knuckle about a pin, characterized in that it comprises:

a notched cam secured to the said moving knuckle;

a contact surface that can be inserted in one of the notches of the cam during an operation of partially or fully opening the door, carried by a moving part;

elastic means acting on the said moving part to apply the said contact surface against the said cam, these means being secured to the fixed knuckle and comprising:

a compression spring;

a support connected to the fixed knuckle and against which one of the ends of the said compression spring bears; and a part hinged to the said fixed support about a pin passing through them and constituting the said moving part, against which the other end of the said compression spring bears.

The said contact surface may be a friction surface, possibly designed as an integral part of the said moving part.

The said contact surface may also be a roller which can rotate about a pin.

As a preference, the door hinge assembly according to the invention is characterized in that the said moving knuckle comprises a housing hinged about the pin that hinges the moving knuckle to the fixed knuckle, in that the said housing supports the said cam on its internal wall, and in that the said moving part and its elastic applying means are included in the said housing.

The said housing preferably has a cover isolating it from the external surroundings.

The said cam may be designed as an integral part of the internal wall of the said housing.

The said contact surface may be made of a self-lubricating material.

The door hinge assembly according to the invention may be shaped in such a way as to allow the said door to be taken off its hinges without it being necessary to dismantle the said assembly.

As will have been understood, the invention consists in building a notched cam into the moving knuckle and in causing a contact surface (a simple friction surface or a rotating roller), borne by a moving part built into the fixed knuckle and actuated by means of a compression spring, to bear against this cam. The extent to which the door is open, chosen by the user, determines the notch of the cam in which the contact surface presses. The moving part can move in rotation about a pin passing through the fixed knuckle. Optimally, the cam, the moving part and the means which actuate it are built into a housing secured to the moving knuckle and an internal wall of which bears the cam. This housing is preferably closed off by a cover which completely isolates the active part of the door hinge assembly from the external surroundings.

BRIEF DESCRIPTION OF THE DRAWINGS

The invention will be better understood upon reading the description which follows, given with reference to the appended FIG. 1 which shows, viewed from the front in section on Ia—Ia (FIG. 1*a*), viewed from the left (FIG. 1*b*), viewed from above in section on Ic—Ic (FIG. 1*c*) and viewed from the front in part section on Id—Id (FIG. 1*d*), one embodiment of the invention.

DETAILED DESCRIPTION OF THE PREFERRED EMBODIMENTS

Figure 1A:
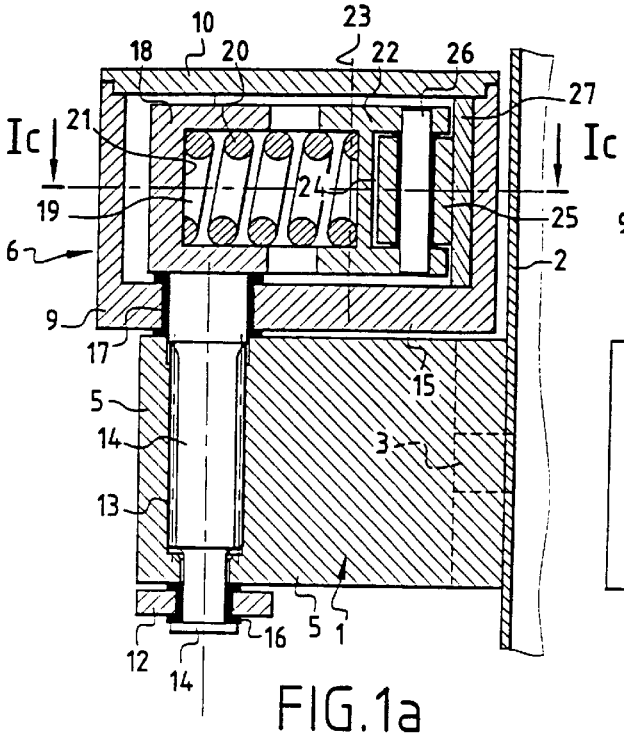
Figure 1B:
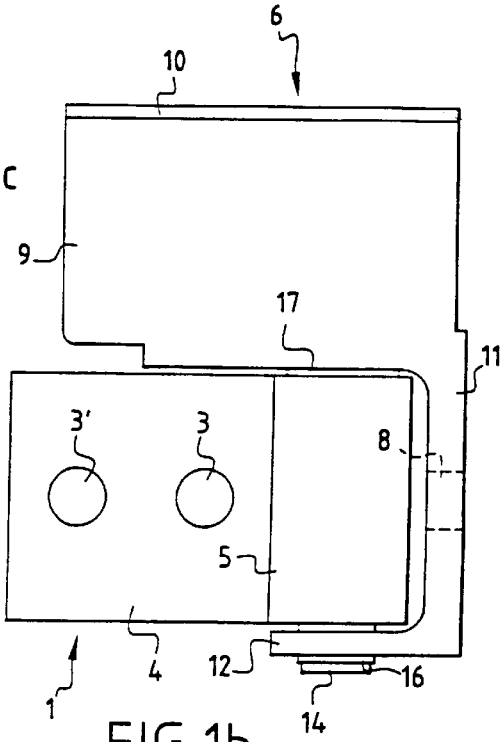

In accordance with the known prior art, the embodiment of the door hinge assembly according to the invention as depicted in FIG. 1 comprises a fixed knuckle 1 intended to be secured to the bodywork 2 of the vehicle. This securing is achieved, for example, using bolts passing through perforations 3, 3' made in the first part 4 of the said fixed knuckle and intended to be applied against the bodywork 2. The fixed knuckle 1 also comprises a second part 5 arranged (in the example depicted) more or less at right angles to the first part 4. Still according to the prior art, a moving knuckle 6 is intended to be secured to the door 7 of the vehicle, for example by bolts passing through perforations 8 (just one of which is depicted). The fixed knuckle 1 and the moving knuckle 6 are hinged together by means which will be described in detail later on.

According to a preferred feature of the invention, the moving knuckle 6 consists at its upper part in a housing 9, the upper part of which is closed off by a cover 10 which isolates the inside of the housing 9 and the components it contains from the external surroundings. This housing 9 is connected via a vertical lug 11 which has the perforations 8 to a sole plate 12 oriented more or less horizontally.

A vertical orifice 13 passes through the second part 5 of the fixed knuckle 1. Its internal face is splined. A splined pin 14 passes through it, its splines corresponding to those of the orifice 13 so as to prevent it from rotating on itself. Its lower end also passes through the sole plate 12 of the moving knuckle 6. Its upper end passes through the end wall 15 of the housing 9 of the moving knuckle 6. Rings 16, 17 made of a self-lubricating material such as PTFE surround the respectively lower and upper ends of the pin 14, allowing the moving knuckle 6 to rotate about the pin 14 which thus constitutes the hinge pin of the door hinge assembly.

Fixed to the upper end of the pin 14 is a support 18 which is a part of elongate overall shape directed generally at right angles to the pin 14. This support 18 is therefore connected to the fixed knuckle 1 via the pin 14. The support 18 has a cavity 19 oriented in the same way. A compression spring 20 presses via one of its ends against the end wall 21 of the cavity 19.

The other end of this spring 20 bears against a part 22 which is hinged to the support 18 about a pin 23 which passes more or less vertically through it and is in offset position with respect to the pin about which the spring 20 exerts its action. Thus, the part 22 hinged to the support 18 can move in rotation about the pin 23 under the effect of the spring 20.

On its external face (that is to say on the opposite face to the one on which the spring 20 exerts its action), the hinged part 22 has a recess 24 which houses a roller 25 which can rotate about a pin 26 more or less at right angles to the direction of travel of the hinged part 22.

The external face of the roller 25 protrudes from the external face of the part 22 so as to constitute a surface for contact with a notched cam 27 in the shape of an arc of a circle secured to the internal face of the housing 9, or designed as an integral part thereof. The notches of the cam 27 have a shape that corresponds to that of the roller 25.

Figure 1C:
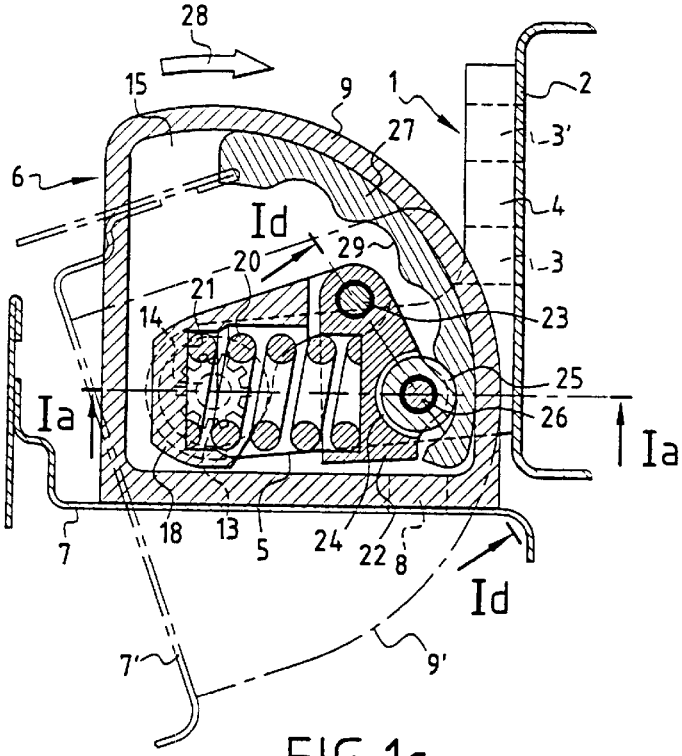
Figure 1D:
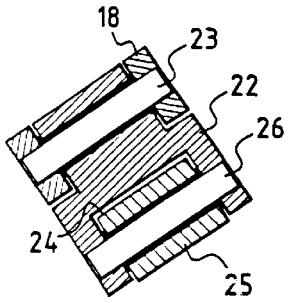

FIG. 1*c* depicts, in solid line, the configuration of the door hinge assembly when the door 7 is in the closed position. Broken line has also been used to depict the respective positions 7' and 9' of the door 7 and of the housing 9 when the door 7 is in the wide-open position after having been actuated in the direction of the arrow 28. It will be understood that in the last case, the roller 25 becomes lodged in the notch 29 of the cam 27, which notch is located at the opposite end of the cam 27 to the end at which the notch in which the roller 25 becomes housed when the door is in the closed position is situated. The intermediate notches of the cam 27 allow the door 7 to be held in predefined partly-open positions, as the user wishes.

At the manufacturer's choice, the support 18 and the pin 14 may consist of two parts secured together or may be combined into a single part.

The cam 27 and the roller 25 may each be made of plastic or metal. Their wear is easily compensated for by the spring 20, at least as long as the wear is not too pronounced. An advantage of the configuration which has just been described is that it is possible to make the cam 27 and the roller 25 both of metal and to lubricate their area of contact without dust and other dirt being able to contaminate the grease, because the cover 10 isolates this area of contact from the external surroundings. The cover 10 is also an acoustic barrier which deadens the noise of operation of the door hinge assembly. In this respect, it may also make it possible to dispense with the greasing of the area of contact between the cam 27 and the roller 25 while at the same time keeping door hinge assembly operating noises down to a level acceptable to the user, and generally substantially less annoying (in terms of intensity and in terms of frequency) than the operating noises of known assemblies. It also prevents ambient moisture from corroding the parts contained by the housing 9.

By comparison with the previously described known devices, the door hinge assembly according to the invention has several advantages. The use of a compression spring arranged horizontally instead of a torsion or tension spring directed vertically makes the active part of the door hinge assembly not have too much bulk in the height direction, therefore making it easier to fit in a vehicle when the specification dictates small-sized locations for these assemblies. Furthermore, as stated, a compression spring is easier and less expensive to manufacture than a bending or torsion spring. In addition, the invention involves the use of just one roller 25/cam 27 assembly as opposed to two in the door hinge assembly described in the document FR 00 1856 already cited, which makes it more compact. Finally, the mechanical and acoustic advantages of the possibility of incorporating the active part of the door hinge assembly according to the invention in a housing 9, preferably one with a cover 10, have already been mentioned. Aside from the technical advantages already discussed, the presence of this housing 9 makes it possible to improve the aesthetic appearance of the door hinge assembly by comparison with the previously known assemblies with built-in door stop.

It must, however, be clearly understood that the housing 9 is not an essential part of the invention, and that the cam 27 may be fixed directly to the moving knuckle 6.

Furthermore, it would remain within the spirit of the invention if the roller 25 capable of rotating about the pin 26 were replaced by a simple fixed friction surface consisting of a pad of metallic or self-lubricating material fixed to the end of the hinged piece 22. An alternative form of that configuration would consist in designing the pad as an integral part of the hinged part 22, which would thus be made entirely of a material which encourages it to slide freely over the cam 27, with or without greasing as the manufacturer chooses.

Wear due to friction of the various parts causes only a small amount of degradation in the guidance and holding of the hinged part 22.

Another advantage of the invention is that it makes it possible to design a door hinge assembly that allows the door 7 to be unhinged from the bodywork 2 of the vehicle. In other words, the door 7 and the bodywork 2 can be taken apart simply by lifting the door 7 to cause the splined pin 14 to emerge vertically from its housing 13 made in the fixed knuckle 1. To do that, it is necessary for no parts to be shaped in such a way as to impede this vertical movement (particularly the lower part of the splined pin 14 and the lower part of the moving knuckle 6), and also for the door 7 actually to be able to be moved vertically over a sufficient height to allow the pin 14 to come out of the housing 13 without being impeded by the bodywork 2. The door 7 can then be unhinged without the need to dismantle the door hinge assembly, something which was not the case with the devices of the prior art.

What is claimed is:

1. A vehicle door hinge assembly with a built-in door stop mechanism, comprising:

a fixed knuckle intended to be secured to the bodywork of the vehicle;

a moving knuckle intended to be secured to the door of the vehicle; and means of hinging said moving knuckle to said fixed knuckle about a first pin, wherein the door hinge assembly comprises:

a notched cam secured to said moving knuckle;

a contact surface that can be inserted in one of the notches of the cam during an operation of partially or fully opening the door, carried by a moving part; and elastic means acting on said moving part to apply said contact surface against said cam, said elastic means being secured to the fixed knuckle and comprising:

a compression spring;

a support connected to the fixed knuckle and against which one end of the said compression spring bears; and a part hinged to said support about a second pin passing through the support and the part hinged to the support and constituting said moving part, against which another end of said compression spring bears.

2. The door hinge assembly according to claim 1, wherein said contact surface is a friction surface.

3. The door hinge assembly according to claim 2, wherein said friction surface is an integral part of said moving part.

4. The door hinge assembly according to claim 1, wherein said contact surface is a roller which rotates about a third pin.

5. The door hinge assembly according to claim 1, wherein said moving knuckle comprises a housing hinged about the first pin that hinges the moving knuckle to the fixed knuckle, wherein said housing supports said cam on an internal wall of the housing, said internal wall of said housing facing said moving knuckle, and wherein said moving part and said elastic means are included in said housing.

6. The door hinge assembly according to claim 5, wherein said housing has a cover isolating the housing from the external surroundings.

7. The door hinge assembly according to claim 5, wherein said cam is designed as an integral part of the internal wall of said housing.

8. The door hinge assembly according to claim 1, wherein said contact surface is made of a self-lubricating material.

9. The door hinge assembly according to claim 1, wherein said door hinge assembly is shaped in such a way as to allow said door to be unhinged without dismantling said door hinge assembly.

10. A vehicle door hinge assembly with a built-in door stop mechanism, comprising:

a fixed knuckle to secure the door hinge assembly to the bodywork of the vehicle;

a moving knuckle to secure the door hinge assembly to the door of the vehicle;

a first pin hinging said moving knuckle to said fixed knuckle;

a notched cam having a plurality of notches connected to said moving knuckle;

a hinged part supporting a contact surface that inserts in one of said plural notches when the door is partially or fully opened; and an elastic mechanism acting on said moving part to urge said contact surface against said notched cam, said elastic mechanism being secured to the fixed knuckle and comprising:

a support connected to the fixed knuckle, and a compression spring having a first end contacting said support, wherein said hinged part is hinged to said support about a second pin that passes through the hinged part and the support, and a second end of said compression spring contacts said hinged part.

* * * * *